US008451184B2

(12) United States Patent
Murakami

(10) Patent No.: US 8,451,184 B2
(45) Date of Patent: May 28, 2013

(54) ANTENNA COIL AND MANUFACTURING METHOD THEREOF

(75) Inventor: Shin Murakami, Tsurugashima (JP)

(73) Assignee: Toko, Inc., Tsurugashima-Shi, Saitama-Ken (JP)

( * ) Notice: Subject to any disclaimer, the term of this patent is extended or adjusted under 35 U.S.C. 154(b) by 387 days.

(21) Appl. No.: 12/927,584

(22) Filed: Nov. 18, 2010

(65) Prior Publication Data

US 2011/0128204 A1 Jun. 2, 2011

(30) Foreign Application Priority Data

Nov. 27, 2009 (JP) ..... 2009-269657
Oct. 1, 2010 (JP) ..... 2010-223570

(51) Int. Cl.
*H01Q 7/08* (2006.01)

(52) U.S. Cl.
USPC ..... 343/788

(58) Field of Classification Search
USPC ..... 343/788, 787, 867, 742
See application file for complete search history.

(56) References Cited

U.S. PATENT DOCUMENTS 7,042,411 B2 * 5/2006 Yagi et al. ..... 343/788
7,796,091 B2 * 9/2010 Ueda ..... 343/788
8,044,875 B2 * 10/2011 Nishino et al. ..... 343/788
8,077,106 B2 * 12/2011 Sato ..... 343/788

FOREIGN PATENT DOCUMENTS

JP 2002-217635 8/2002
JP 2003-092509 3/2003

* cited by examiner

*Primary Examiner* — Hoang V Nguyen
(74) *Attorney, Agent, or Firm* — Renner, Kenner, Greive, Bobak, Taylor & Weber

(57) ABSTRACT

The present invention provides an antenna coil which can be made smaller and intends to improve a receiving sensitivity in consideration of all directions.

According to one embodiment of the present invention, an antenna coil including: a first coil 4 having an X-axis coil wound on an X axis of a first core and a Z-axis coil wound on a Z axis of the first core, the thickness direction of the first core being determined to be the Z-axis, an axis orthogonal to the Z axis being determined to be the X axis; a second coil 5 having a Y-axis coil wound around a second core, the second core having flanges at both ends; four external terminals 3 each connected to a corresponding end of the X-axis coil or the Z-axis coil and additionally provided on the first core; and two external terminals 3 each connected to a corresponding end of the Y-axis coil and additionally provided on the second core. The first coil 4 and the second coil 5 are arranged to be close to each other so that winding axis directions of the X-axis coil, the Y-axis coil, and the Z-axis coil are orthogonal to each other. The first coil 4 and the second coil 5 are integrally molded using an exterior resin 2, leaving part of each of the external terminals to be connected to an external circuit.

7 Claims, 5 Drawing Sheets

ANTENNA COIL AND MANUFACTURING METHOD THEREOF

CROSS REFERENCE TO RELATED APPLICATION

This application is based upon and claims the benefit of priority from the prior Japanese Patent Application No. 2009-269657 filed on Nov. 27, 2009 in Japan, and No. 2010-223570, filed on Oct. 1, 2010 in Japan, the entire contents of which are incorporated herein by reference.

BACKGROUND OF THE INVENTION

1. Field of the Invention

The present invention relates to an antenna coil used in the receiving system of e.g., a keyless entry system of an automobile and a security system, and to a manufacturing method thereof.

2. Related Art

In an antenna coil used in a keyless entry system which is often mounted on an automobile or the like and the receiving system of a security system, a conventional technique in which a plurality of antenna coils wound around rod-like ferrite cores are used so that each of the antenna coils is arranged so as to receive an electric wave in each direction has been known (for instance, see Japanese Patent Application Laid-Open No. 2002-217635). In addition, a technique of forming a small antenna coil using a three-axis core for receiving electric waves in all directions has been disclosed (for instance, see Japanese Patent Application Laid-Open No. 2003-92509). The antenna coil using a three-axis core is shown in FIGS. 8 and 9.

FIG. 8 is a perspective view of a conventional antenna coil, and FIG. 9 shows a three-axis coil 20 configuring FIG. 8. The three-axis coil 20 has a Y-axis coil 25 which is wound in a Y-axis groove 22 which passes through the center of the upper surface and the lower surface of a flat columnar three-axis core 21 made of a ferrite material and is provided so as to divide an outer circumference from the upper surface to the lower surface into two and in which a Y direction is determined to be a winding axis direction, an X-axis coil 26 which is wound in an X-axis groove 23 which is orthogonal to the Y-axis groove 22, passes through the center of the upper surface and the lower surface of the three-axis core 21, and is provided so as to divide the outer circumference from the upper surface to the lower surface into two and in which an X direction is determined to be a winding axis direction, and a Z-axis coil 27 which is wound in a Z-axis groove 24 provided on the outer circumference of the three-axis core 21 and in which when the thickness direction of the three-axis core 21 is determined to be a Z direction, the Z direction is determined to be a winding axis direction.

As shown in FIG. 8, the three-axis coil 20 is housed in a resin case 28 in which four external terminals 29 are provided on opposite side surfaces. In addition, the end of each of the windings of the X-axis coil, the Y-axis coil, and the Z-axis coil is electrically connected to the predetermined external terminal 29.

In the above three-axis coil 20, flange portions at both ends of the Z-axis groove 24, for receiving an electric wave in the Z-axis direction, are divided into four in order to form the X-axis groove 23 and the Y-axis groove 22. In other words, the width of the X-axis groove 23 and the width of the Y-axis groove 22 reduce the area of the flange portions at both ends of the Z-axis coil 27. For this reason, the characteristic of the Z-axis coil 27 is lower than that of the X-axis coil 23 and the Y-axis coil 25. To improve this problem, the number of turns in the Z-axis coil 27 may be increased or the thickness of the three-axis core 21 may be increased, but the shape of the antenna coil is increased, and thinning is inhibited.

In addition, because the X-axis groove 23 and the Y-axis groove 22 are provided so that the winding axis directions of the X-axis coil 26 and the Y-axis coil 25 are orthogonal to each other, the areas of the flanges of the X-axis coil and the Y-axis coil are reduced, thereby deteriorating the characteristic. In other words, the areas of the flanges at both ends of the X-axis groove 26 divided into two by the Y-axis groove 22 are reduced due to the width of the Y-axis groove 22. In other words, the characteristic of the X-axis coil 26 is deteriorated by the reduced area of the flange of the X-axis coil. Likewise, the characteristic of the Y-axis coil 25 is also deteriorated.

Further, when the respective windings are close to or contact each other in the uppermost portion of the winding (the winding end portion) of the X-axis coil 23 and the lowermost portion of the winding (the winding start portion) of the Y-axis coil 22, capacitive coupling occurs. The capacitance of the capacitive coupling is changed according to the connecting method of the X-axis coil 26, the Y-axis coil 25, and the Z-axis coil 27, thereby deteriorating the characteristic of the antenna coil.

SUMMARY OF THE INVENTION

The present invention has been made in view of the above problems and provides an antenna coil which can be made smaller and intends to improve a receiving sensitivity in consideration of all directions.

According to one embodiment of the present invention, in order to solve above problems, there is provided an antenna coil including:

a first coil having an X-axis coil wound on an X axis of a first core and a Z-axis coil wound on a Z axis of the first core, the thickness direction of the first core being determined to be the Z-axis, an axis orthogonal to the Z axis being determined to be the X axis;

a second coil having a Y-axis coil wound around a second core, the second core having flanges at both ends;

four external terminals each connected to a corresponding end of the X-axis coil or the Z-axis coil and additionally provided on the first core; and two external terminals each connected to a corresponding end of the Y-axis coil and additionally provided on the second core, wherein the first coil and the second coil are arranged to be close to each other so that winding axis directions of the X-axis coil, the Y-axis coil, and the Z-axis coil are orthogonal to each other, wherein the first coil and the second coil are integrally molded using an exterior resin, leaving part of each of the external terminals to be connected to an external circuit.

Furthermore, each of the external terminals of the first coil may include a connecting section connected to the corresponding end of the X-axis coil or the Z-axis coil, a base may be resin-molded to one end of the external terminal and a portion except for the connecting section, the base being bonded and fixed to one surface of the first core, and each of the external terminals of the second coil may include a connecting section connected to the corresponding end of the Y-axis coil, each of the flanges of the second core being bonded and fixed to the end of the corresponding external terminal of the second coil.

Furthermore, an end of a non-molded portion of the external terminal may be formed along an outer shape of the exterior resin.

Furthermore, the distance between the core outer circumference of the first coil and the core outer circumference of the second coil may be 0.5 mm or more.

Moreover, in accordance with another embodiment of the present invention, there is provided an antenna coil manufacturing method including:

manufacturing a first coil including:

stamping external terminals having connecting sections with respect to a continuous frame;

forming a base with respect to part of opposite ends of the external terminals by resin molding;

bonding and fixing a bottom surface of a first core to the base;

after the bonding and fixing, cutting an end of each of the external terminals from the frame;

determining the thickness direction of the first core to be a Z axis, determining an axis orthogonal to the Z axis to be an X axis, performing winding on the X axis of the first core to form an X-axis coil, and performing winding on the Z axis of the first core to form a Z-axis coil; and tying each of ends of the X-axis coil and the Z axis coil to the corresponding connecting section for electrical connection;

manufacturing a second coil including:

stamping external terminals having connecting sections with respect to a continuous frame;

bonding and fixing two opposite ends of the external terminals to bottom surfaces of flanges at both ends of a second core;

after the bonding and fixing, cutting an end of each of the external terminals from the frame;

performing winding around the second core to form a Y-axis coil; and tying each of ends of the Y-axis coil to the corresponding connecting section for electrical connection;

arranging the first coil and the second coil to be close to each other so that winding axis directions of the X-axis coil, the Y-axis coil, and the Z-axis coil are orthogonal to each other; and insert molding an exterior resin around the first coil and the second coil so as to integrate the first coil and the second coil.

According to an antenna coil of the present invention, a two-axis coil as a first coil and a one-axis coil as a second coil are arranged to be close to each other so that the characteristic of the two-axis coil can be made full use of, and the outer circumferences of the first coil and the second coil are integrated using an exterior resin so that the antenna coil can be made smaller and thinner and that an improvement in receiving sensitivity in consideration of all directions can be obtained.

DETAILED DESCRIPTION OF THE INVENTION

Hereafter, an embodiment of the present invention will be described with an example.

Figure 1:
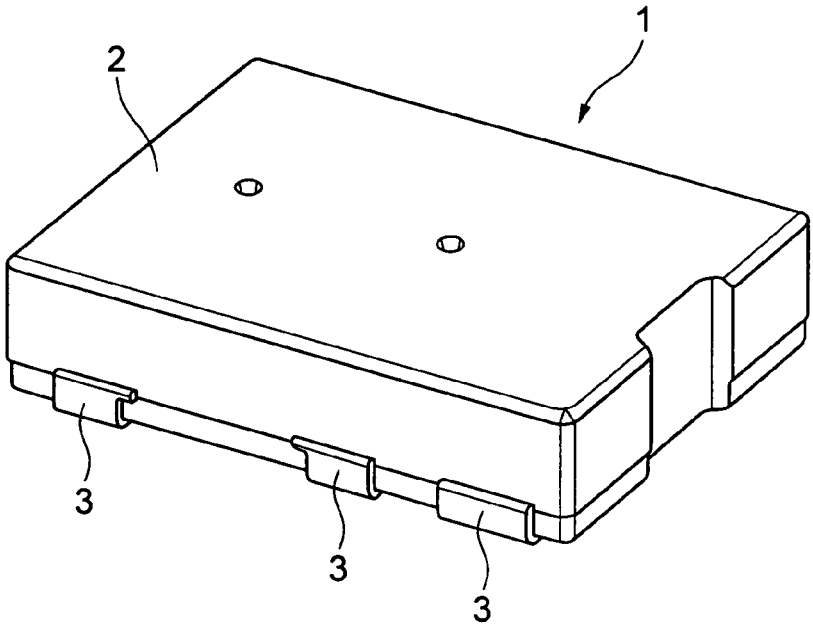
FIG. 1 is a perspective view showing the appearance of an antenna coil of the present invention.
Figure 2:
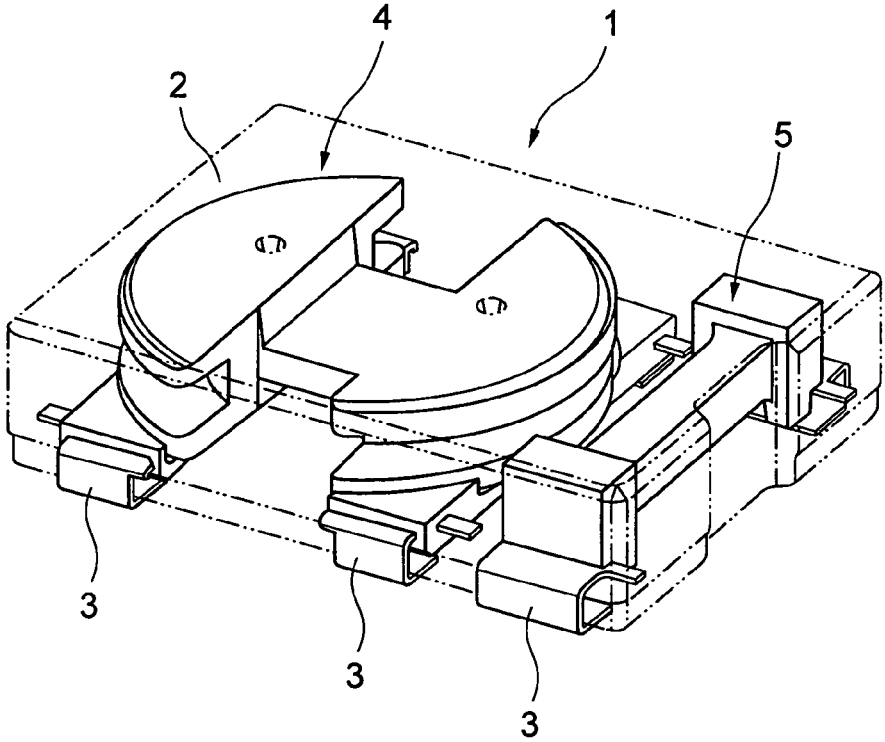
FIG. 2 is a transmitting view showing the interior of the antenna coil shown in FIG. 1.

FIG. 1 is a perspective view showing the appearance of an antenna coil of the present invention, and FIG. 2 is a transmitting view showing the interior of the antenna coil of the present invention.

As shown in FIG. 1, an antenna coil 1 has an exterior resin 2, and six external terminals 3. In the exterior resin 2, a heat-resistant insulating resin material, such as an epoxy resin material and a silicone resin material, is formed to be thin and in a substantially cubic shape which has a bottom surface of 8.6 mm by 11.5 mm, and a height of 2.9 mm.

The antenna coil 1 has three external terminals 3 provided on each of two opposite side surfaces, that is, six external terminals 3 (three of them on the opposite side are not seen). The external terminals 3 are mount terminals which are drawn out from the side surfaces of the exterior resin 2 and are formed along the bottom surface. The six external terminals 3 extend from two coils in the interior of the exterior resin 2.

FIG. 2 shows a transmitting view in which a first coil and a second coil which are buried in the interior of the exterior resin 2 of the antenna coil shown in FIG. 1 are arranged. As shown in the drawing, in the interior of the exterior resin 2, a two-axis coil 4 as the first coil and a one-axis coil 5 as the second coil are arranged to be close to each other at a predetermined distance.

Figure 3:
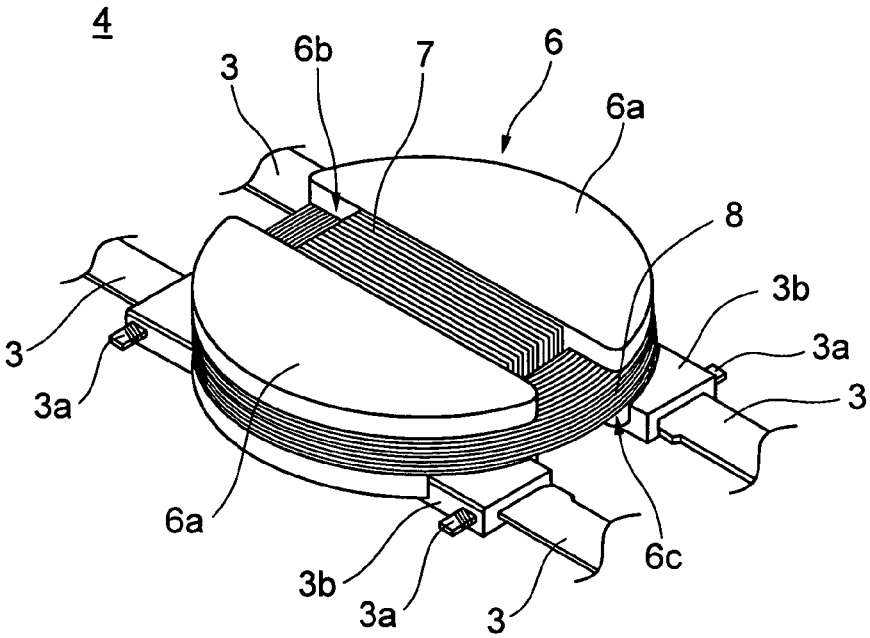
FIG. 3 is a perspective view showing a first coil which is the antenna coil of the present invention.

FIG. 3 is a perspective view showing the two-axis coil 4 as the first coil buried in the interior of the exterior resin 2 of FIG. 2.

The two-axis coil 4 has a flat cylindrical two-axis core 6 made of a ferrite material, the two-axis core 6 being formed with a Z-axis groove 6*c* provided on the outer circumference of the two-axis core 6 in a thickness direction, and an X-axis groove 6*b* which passes through the center of the upper surface and the lower surface of the two-axis core 6 and is provided so as to divide the outer circumference from the upper surface to the lower surface into two. In addition, the two-axis core 6 has flanges 6*a* and 6*a* at both ends of the Z-axis groove 6*c*, the flanges having, on their bottom surfaces, the four external terminals 3 in such a manner that two sets of two opposite external terminals 3 are arranged.

As shown in FIG. 3, in the two-axis coil 4, an X-axis coil 7 wound in the X-axis groove 6*b* of the two-axis core 6 and a Z-axis coil 8 wound in the Z-axis groove 6*c* are formed. To prevent the influence of the magnetic fluxes of the mutual windings, the X-axis coil 7 and the Z-axis coil 8 are formed so that the mutual winding axis directions are orthogonal to each other. Further, connecting sections 3*a* for connecting the ends of the respective windings are integrally provided on the four external terminals 3. The end of each of the windings is tied to the predetermined connecting section 3*a*, and is welded by e.g., a laser beam or the like so as to be electrically connected.

In the example, the flat cylindrical two-axis core has been described, but a plane in a square, regular polygonal, or elliptical shape may be used. In addition, the cross-sectional shape of the winding axes of the X axis and the Z axis may be circular, square, or polygonal.

Figure 4:
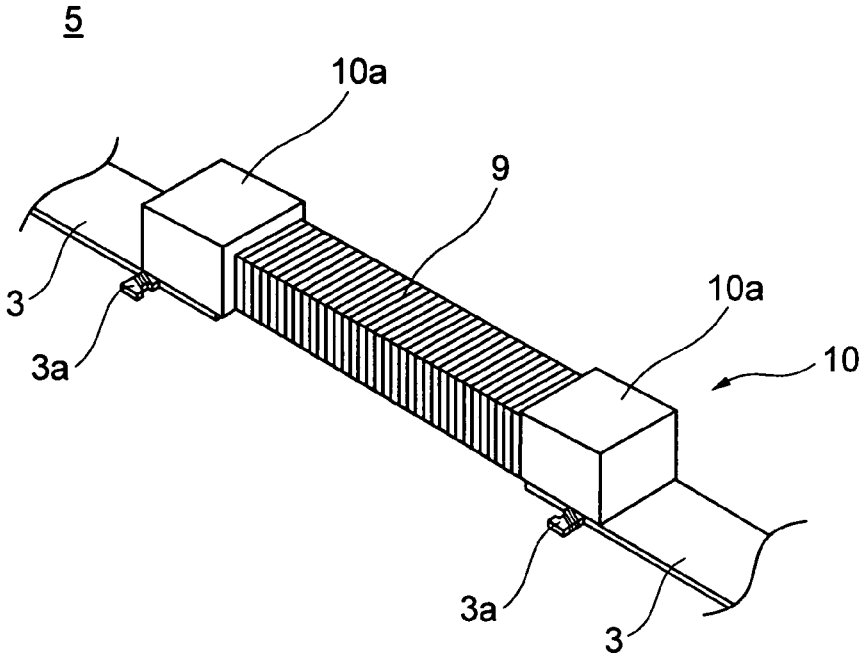
FIG. 4 is a perspective view showing a second coil which is the antenna coil of the present invention.

FIG. 4 is a perspective view showing the one-axis coil 5 as the second coil buried in the interior of the exterior resin 2 of FIG.

As shown in FIG. 4, in the one-axis coil 5, a Y-axis coil 9 is wound around a rod-like one-axis core 10 which has, at both ends, flanges 10*a* with a square cross section and is made of a ferrite material. The two opposite external terminals 3 are provided on the bottom surfaces of the flanges 10*a* at both ends of the one-axis core 10. In addition, the connecting sections 3*a* for connecting the ends of the windings are integrally provided on the external terminals 3. The end of each of the windings of the one-axis coil 5 is tied to the predetermined connecting section 3*a*, and is welded by e.g., a laser beam or the like so as to be electrically connected.

In the example, the cross-sectional shape of the winding axis of the one-axis core is square, but may be circular or polygonal.

As shown in FIG. 2, the two-axis coil 4 and the one-axis coil 5 are arranged to be close to each other at a predetermined distance so that three winding axis directions of the X-axis coil 7 and the Z-axis coil 8 of the two-axis coil 4 and the Y-axis coil 9 of the one-axis coil 5 are orthogonal to each other. The outer circumferences combining the two-axis coil 4 and the one-axis coil 5 except for part of each of the external terminals 3 are integrally formed to be thin and in a substantially cubic shape by the exterior resin 2. Here, the winding axis direction of the X-axis coil of the two-axis coil 4 and the winding axis direction of the Y axis coil of the one-axis coil 5 are arranged to be orthogonal to each other. Because the magnetic fluxes of the three coils of the X-axis coil and the Z-axis coil of the two-axis coil 4 and the Y-axis coil of the one-axis coil are orthogonal to each other, there is no influence of the mutual magnetic fluxes of the respective coils.

As described above, because the winding axis directions of the three coils of the X-axis coil and the Z-axis coil of the two-axis coil and the Y-axis coil of the one-axis coil are arranged to be orthogonal to each other, each of the coils is not affected by the magnetic fluxes in the receiving directions of the others. In addition, unlike the conventional antenna coil using a three-axis coil, because the X-axis coil and the Y-axis coil are not wound around the same core, the winding start portion of the X-axis coil and the winding end portion of the Y-axis coil are not close to or do not contact each other. For this reason, there is an advantage that the deterioration of the characteristic due to occurrence of capacitive coupling can be prevented.

Next, an antenna coil manufacturing method of the present invention will be described in detail with reference to FIGS. 5 and 6.

A method for manufacturing the two-axis coil as the first coil will be described.

Figure 5:
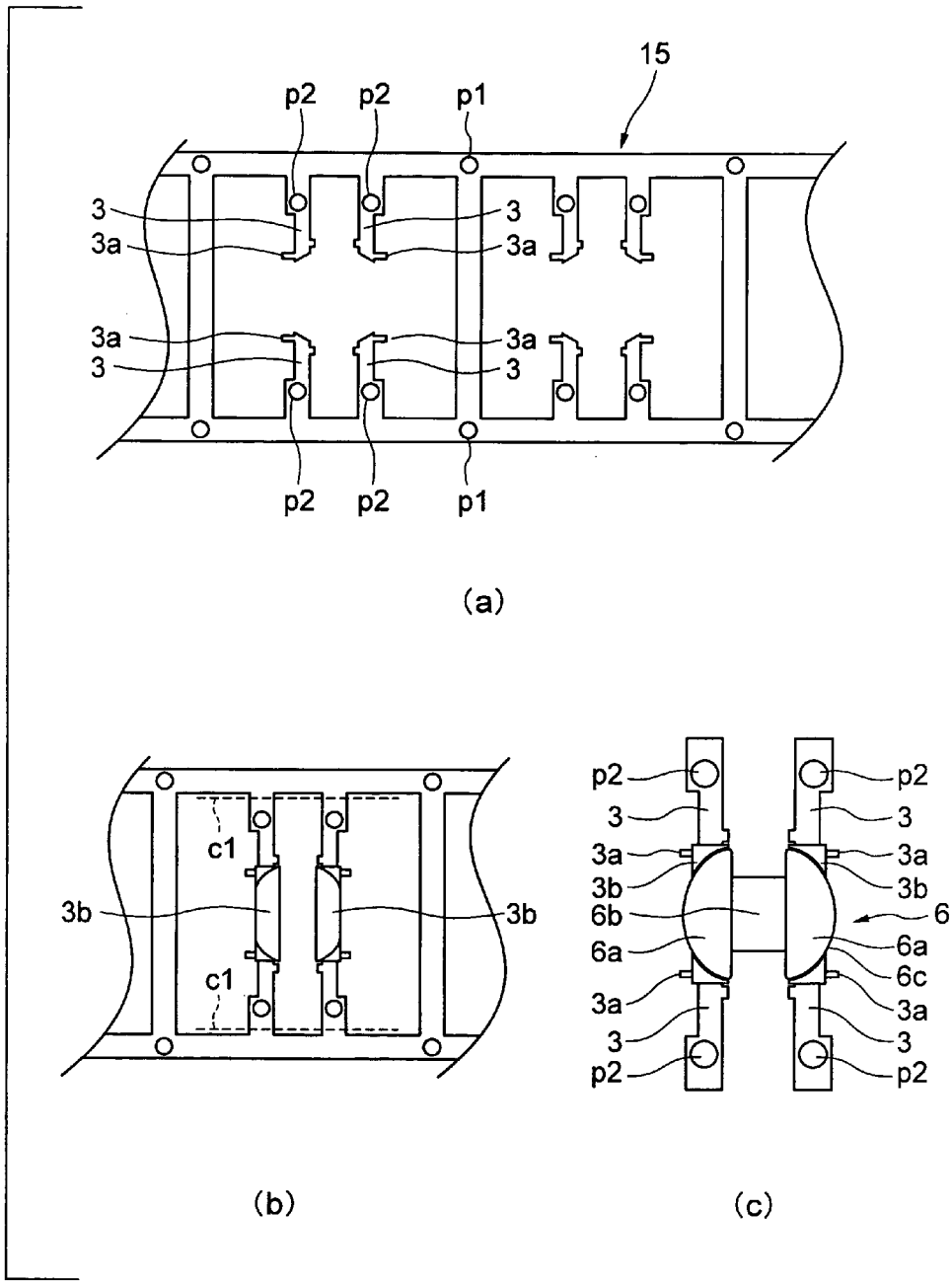
FIG. 5 shows a frame providing metal terminals used in the first coil (a), bases provided to the frame (b), and a plan view in which a first core is fixed to the bases (c)

As shown in FIG. 5(*a*), in the two-axis core 6 forming the two-axis coil 4, the external terminals 3 including the connecting sections 3*a* for connecting the ends of the windings are previously integrally formed with respect to a continuous frame 15 formed by stamping a thin metal plate. The four external terminals 3 are provided with respect to the frame 15 in such a manner that two sets of two opposite external terminals 3 are arranged. The frame 15 is manufactured by stamping a thin plate which has a size of 0.1 to 0.2 mm and is made of, e.g., a phosphor bronze material or the like, using a press.

A plurality of work locate holes p1 and p2 for facilitating the positioning of a work are provided in the frame 15.

Then, as shown in FIG. 5(*b*), two bases 3*b* are formed with respect to the frame 15, so that, in the four external terminals 3 which are arranged as two sets of two opposite external terminals 3, the ends of the two opposite external terminals 3 are insert molded into a predetermined shape using a heat-resistant insulating resin. The ends of the two opposite external terminals in the interior of each of bases 3*b* are separated from each other. At the time of the insert molding of the bases 3*b*, the work locate holes p1 and p2 are used for facilitating the positioning and fixing with respect to a mold die.

Then, as shown in FIG. 5(*c*), the two bases 3*b* provided with respect to the frame 15 and the bottom surfaces of the two flanges 6*a* and 6*a* in a substantially semicircular shape of the two-axis core 6 are strongly fixed using an adhesive. In addition, the two-axis core 6 bonded and fixed to the bases 3*b* of the frame 15 is separated from the frame 15 by cutting the portions between the outer frame of the frame 15 and the work locate holes p2 (the dashed line portions c1 in the drawing).

It should be noted that when metal external terminals are directly bonded and fixed to the flanges of the two-axis core, the value of Q of the Z-axis coil is reduced by several percent and the value of Q of the X-axis coil is reduced by as much as several 10%. By providing the insulating resin bases to the external terminals, there are effects of preventing the reduction of the value of Q and the breakage of the flanges of the two-axis core, and of improving the bonding strength.

Then, as shown in FIG. 3, winding is performed in the X-axis groove 6*b* of the separated two-axis core 6, and the end of the winding is tied to the predetermined connecting section 3*a* to form the X-axis coil 7. Further, winding is performed in the Z-axis groove 6*c* of the two-axis core 6, and the end of the winding is tied to the predetermined connecting section 3*a* to form the Z-axis coil 8. After each of the windings is performed, the connecting section 3*a* to which the end of the winding is tied is irradiated with, e.g., a laser beam, to weld each of the connecting sections 3*a* and the end of the winding of the portion tied thereto so as to be electrically connected.

Next, a method for manufacturing the one-axis coil as the second coil will be described. Because the frame to which the one-axis core is bonded and fixed is similar to the frame to which the two-axis core is bonded and fixed, the drawing thereof is omitted, and like reference numerals are used for similar portions. However, the one-axis core is different from the two-axis coil in that no insulating resin bases are provided to metal terminals.

As shown in FIG. 4, the one-axis core 10 forming the one-axis coil 5 has a rod-like core having, at both ends, the flanges 10*a* with a square cross section. In the method for manufacturing the one-axis coil 5, like the two-axis coil 4, the external terminals 3 including the connecting sections 3*a* for connecting the ends of the windings are previously integrally formed with respect to the continuous frame 15 formed by stamping a thin metal plate, and the two opposite external terminals 3 are provided. The plurality of work locate holes p1 and p2 (see FIG. 6) for facilitating the positioning of a work are provided in the frame 15.

Then, the ends of the two opposite external terminals 3 except for the connecting sections 3*a* are bonded and fixed so as to coincide with the bottom surfaces of the flange portions at both ends of the one-axis core 10.

After the bonding and fixing, as in the two-axis core 6, the portions between the outer frame of the frame 15 and the work locate holes p2 are cut to separate the one-axis core 10 from the frame.

Winding is performed on the axis interposed between the flanges at both ends of the separated one-axis core 10, the end of the winding is tied to the predetermined connecting section 3, and as in the two-axis coil, each of the connecting sections 3*a* and the end of the winding of the portion tied thereto are welded by being irradiated with, e.g., a laser beam, so as to be electrically connected, thereby forming the one-axis coil 5.

In addition, in the example, the connection of the ends of the windings has been described using laser welding, but they may be connected by using other connecting methods such as soldering or the like.

Then, the antenna coil combining the first coil and the second coil is formed.

Figure 6:
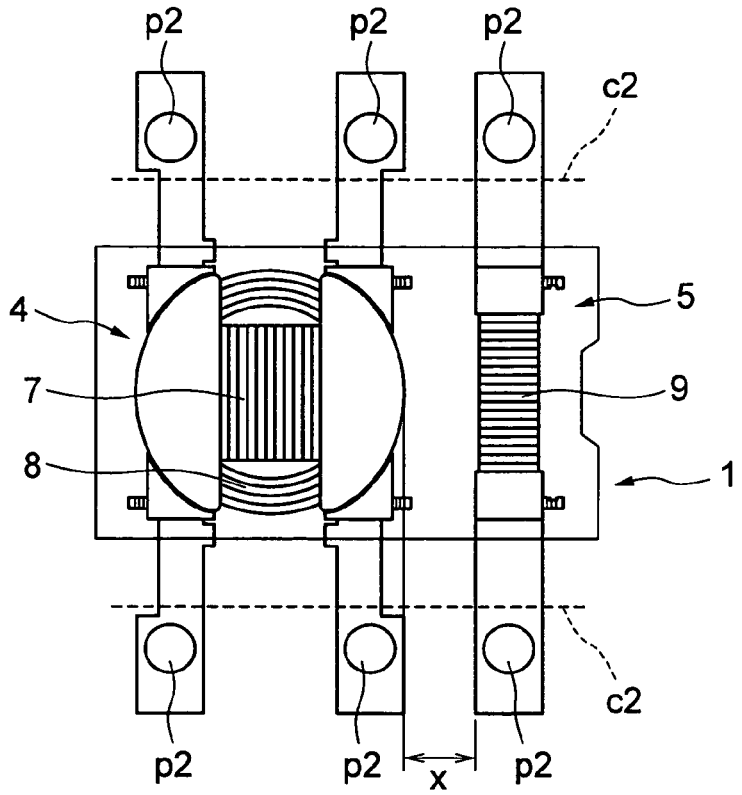
FIG. 6 is a plan view showing an arranging view of the first coil and the second coil.

FIG. 6 shows a plan view showing the arranging view of the first coil and the second coil.

Six locate pins which are arranged at a predetermined distance are provided on the mold die. The locate pins are inserted into the four work locate holes p2 provided in the two-axis coil 4 and the two work locate holes p2 provided in the one-axis coil 5. Then, the exterior resin 2 is formed to be thin and in a substantially cubic shape, leaving the ends of the six external terminals 3 including the work locate holes p2 by an insert molding machine. At this time, the distance between the four work locate holes p2 provided in the external terminals 3 of the two-axis coil 4 and the two work locate holes p2 provided in the external terminals 3 of the one-axis coil 5 is previously set so that the distance between the core outer circumference of the two-axis coil 4 and the flange outer circumference of the one-axis coil 5 can be determined. The distance is desirably about 0.5 mm or more as long as the outer shape permits.

With the distance (less than 0.5 mm) so that the two-axis coil and the one-axis coil contact each other, the inductance coupling between the two-axis coil and the one-axis coil is increased so that the frequency waveforms of the respective coils are deformed, resulting in troubling the communication function.

Then, as shown in FIG. 6, after the insert molding, six metal terminals as non-molded portions of the exterior resin 2 are cut by the dashed line portions c2 near the work locate holes p2. As shown in FIG. 1, the remaining external terminals 3 are formed along the bottom surface side from the draw-out surfaces of the side surfaces of the exterior resin 2, for external connection, thereby obtaining the antenna coil of the present invention of FIG. 1.

In this way, the antenna coil manufacturing method of the present invention can facilitate the fixing of the two-axis core and the one-axis core, and the metal terminals by using the frame, can facilitate the arrangement of the first coil as the two-axis coil and the second coil as the one-axis coil by using the work locate holes p2 provided in the frame, and can ensure the fixing at the time of the insert molding of the exterior resin 2 to increase the accuracy of the position at the time of the insert molding.

Figure 7:
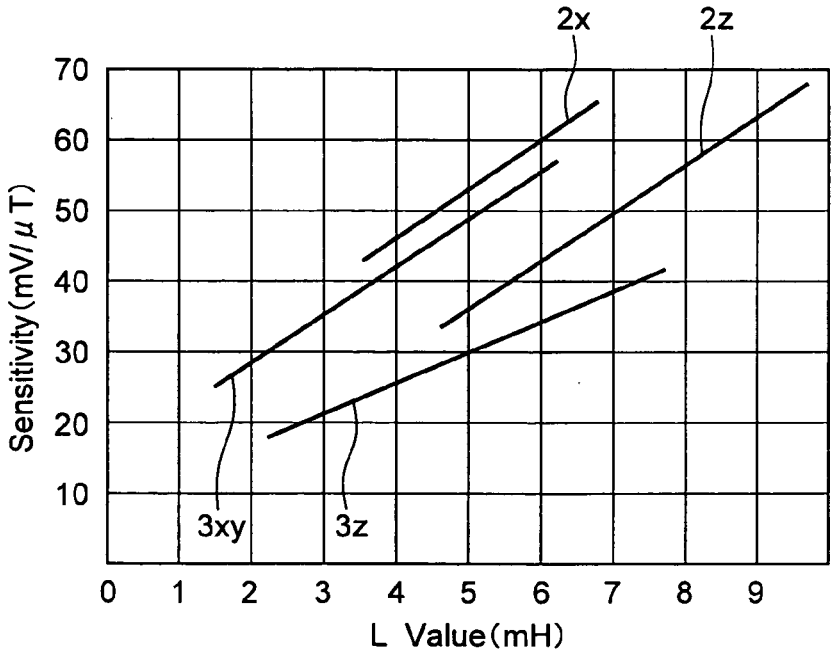
FIG. 7 is a graph for comparison of the characteristics of the first coil of the antenna coil of the present invention and a conventional antenna coil having a three-axis coil.
Figure 8:
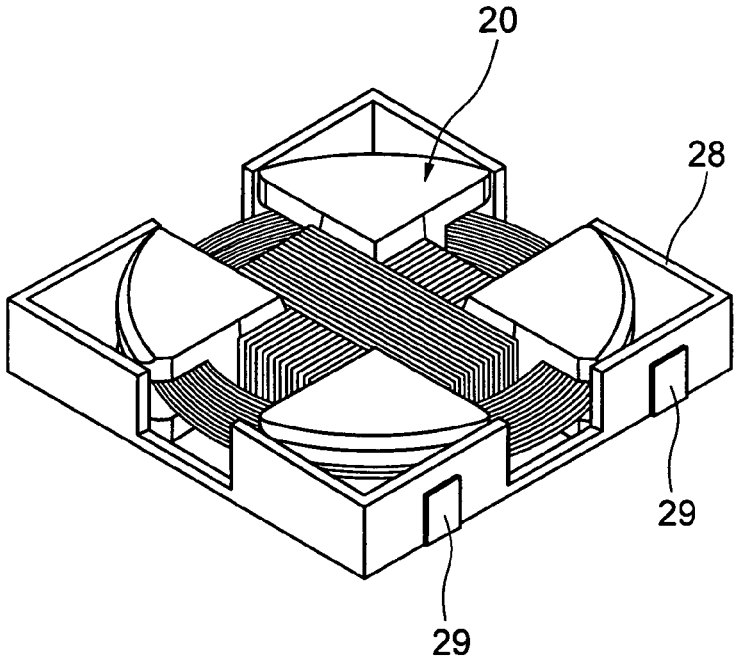
FIG. 8 is a schematic diagram showing the appearance of the conventional antenna coil.
Figure 9:
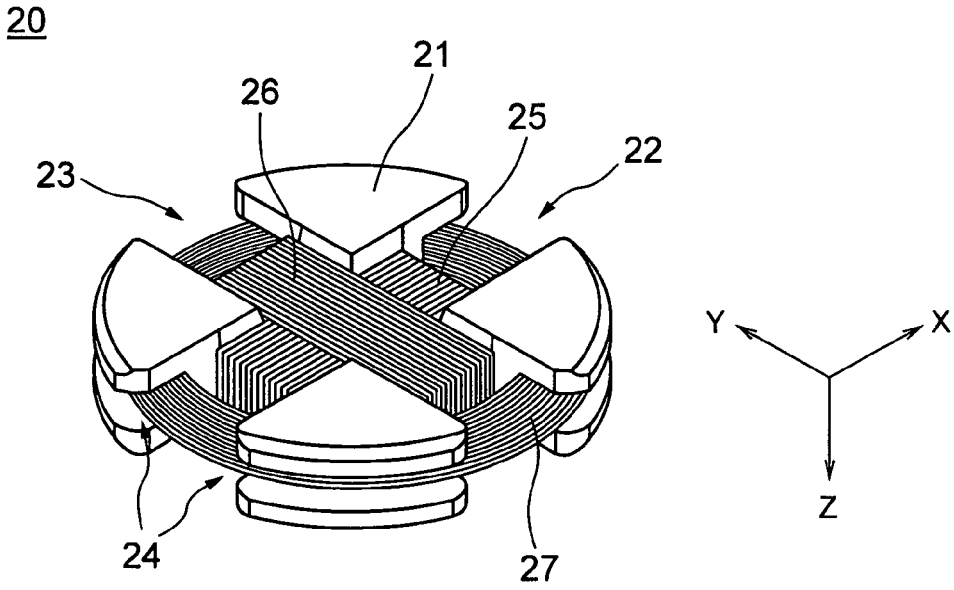
FIG. 9 is a diagram showing the three-axis coil of the conventional antenna coil.

FIG. 7 shows the results obtained by comparing the characteristics of the antenna coil using the above-manufactured two-axis coil and one-axis coil, and the conventional antenna coil using a three-axis coil. The outer shape dimensions, the winding grooves, and the number of turns in the two-axis core and the three-axis core are the same.

In FIG. 7, inductance values (mH) are shown on the horizontal axis and the sensitivity data of sensitivity (mV/μT) is shown on the vertical axis. Here, the characteristic of the conventional three-axis coil is shown by 3*xy* and 3*z*, and the characteristic of the two-axis coil used in the present invention is shown by 2*x* and 2*y*.

As shown in FIG. 7, it is found that the use of 2*x* and 2*z* of the two-axis coil of the present invention offers an inductance value and a sensitivity larger than the use of 3*xy* and 3*z* of the conventional three-axis coil. Because of this, the antenna coil of the present invention can be smaller or thinner, if it has the same characteristic as the conventional three-axis coil.

The invention claimed is:

1. An antenna coil comprising:

a first coil having an X-axis coil wound on an X axis of a first core and a Z-axis coil wound on a Z axis of the first core, the thickness direction of the first core being determined to be the Z-axis, an axis orthogonal to the Z axis being determined to be the X axis;

a second coil having a Y-axis coil wound around a second core, the second core having flanges at both ends;

four external terminals each connected to a corresponding end of the X-axis coil or the Z-axis coil and additionally provided on the first core; and two external terminals each connected to a corresponding end of the Y-axis coil and additionally provided on the second core, wherein the first coil and the second coil are arranged to be close to each other so that winding axis directions of the X-axis coil, the Y-axis coil, and the Z-axis coil are orthogonal to each other, wherein the first coil and the second coil are integrally molded using an exterior resin, leaving part of each of the external terminals to be connected to an external circuit.

2. The antenna coil according to claim 1, wherein each of the external terminals of the first coil comprises a connecting section connected to the corresponding end of the X-axis coil or the Z-axis coil, wherein a base is resin-molded to one end of the external terminal and a portion except for the connecting section, the base being bonded and fixed to one surface of the first core, wherein each of the external terminals of the second coil comprises a connecting section connected to the corresponding end of the Y-axis coil, each of the flanges of the second core being bonded and fixed to the end of the corresponding external terminal of the second coil.

3. The antenna coil according to claim 1, wherein the first core is made of ferrite and is flat, wherein the plane of the first core has any one of a circular shape, a square shape, or a polygonal shape.

4. The antenna coil according to claim 1, wherein an end of a non-molded portion of the external terminal is formed along an outer shape of the exterior resin.

5. The antenna coil according to claim 1, wherein the distance between the core outer circumference of the first coil and the core outer circumference of the second coil is 0.5 mm or more.

6. An antenna coil manufacturing method comprising:

manufacturing a first coil including:

stamping external terminals having connecting sections with respect to a continuous frame;

forming a base with respect to part of opposite ends of the external terminals by resin molding;

bonding and fixing a bottom surface of a first core to the base;

after the bonding and fixing, cutting an end of each of the external terminals from the frame;

determining the thickness direction of the first core to be a Z axis, determining an axis orthogonal to the Z axis to be an X axis, performing winding on the X axis of the first core to form an X-axis coil, and performing winding on the Z axis of the first core to form a Z-axis coil; and tying each of ends of the X-axis coil and the Z-axis coil to the corresponding connecting section for electrical connection;

manufacturing a second coil including:

stamping external terminals having connecting sections with respect to a continuous frame;

bonding and fixing two opposite ends of the external terminals to bottom surfaces of flanges at both ends of a second core;

after the bonding and fixing, cutting an end of each of the external terminals from the frame;

performing winding around the second core to form a Y-axis coil; and tying each of ends of the Y-axis coil to the corresponding connecting section for electrical connection;

arranging the first coil and the second coil to be close to each other so that winding axis directions of the X-axis coil, the Y-axis coil, and the Z-axis coil are orthogonal to each other; and insert molding an exterior resin around the first coil and the second coil so as to integrate the first coil and the second coil.

7. The antenna coil manufacturing method according to claim 6, further comprising, after the insert molding, forming the end of the non-molded portion of the external terminal along the shape of the exterior resin.

* * * * *